US009156133B2

(12) United States Patent
Miller

(10) Patent No.: US 9,156,133 B2
(45) Date of Patent: Oct. 13, 2015

(54) WATERJET ASSEMBLY COMPRISING A STRUCTURAL WATERJET NOZZLE

(75) Inventor: Donald Miller, Bedford (GB)

(73) Assignee: FINEPART SWEDEN AB, Bollebygd (SE)

( * ) Notice: Subject to any disclaimer, the term of this patent is extended or adjusted under 35 U.S.C. 154(b) by 499 days.

(21) Appl. No.: 13/514,652

(22) PCT Filed: Dec. 10, 2010

(86) PCT No.: PCT/EP2010/069381

§ 371 (c)(1),
(2), (4) Date: Jun. 8, 2012

(87) PCT Pub. No.: WO2011/070154

PCT Pub. Date: Jun. 16, 2011

(65) Prior Publication Data

US 2012/0238188 A1 Sep. 20, 2012

(30) Foreign Application Priority Data

Dec. 11, 2009 (GB) ..... 0921681.3

(51) Int. Cl.
*B24C 5/02* (2006.01)
*B24C 5/04* (2006.01)
*B24C 1/04* (2006.01)

(52) U.S. Cl.
CPC . *B24C 5/02* (2013.01); *B24C 1/045* (2013.01); *B24C 5/04* (2013.01)

(58) Field of Classification Search
CPC ..... B24B 5/02; B24B 5/04; B24C 1/045
USPC ..... 239/592–595; 451/90, 102
See application file for complete search history.

(56) References Cited

U.S. PATENT DOCUMENTS

| | | | | | |
|---|---|---|---|---|---|
| 2,376,287 | A | * | 5/1945 | Sorrentino | 451/101 |
| 2,717,476 | A | * | 9/1955 | Myers | 451/102 |
| 3,228,147 | A | * | 1/1966 | Moore | 451/102 |
| 3,796,371 | A | | 3/1974 | Taylor et al. | |
| 4,342,425 | A | * | 8/1982 | Vickers | 239/424 |
| 4,633,623 | A | * | 1/1987 | Spitz | 451/102 |
| 4,836,455 | A | | 6/1989 | Munoz | |

(Continued)

FOREIGN PATENT DOCUMENTS

WO 02096567 A1 12/2002

OTHER PUBLICATIONS

International Search Report for PCT/EP2010/069381 dated Apr. 13, 2011.

*Primary Examiner* — Timothy V Eley
(74) *Attorney, Agent, or Firm* — Heslin Rothenberg Farley & Mesiti P.C.

(57) ABSTRACT

A waterjet assembly for an entrainment waterjet cutting head device comprises a passaged component adapted to be connected to a source of pressurised water and a waterjet nozzle for converting water pressure energy to kinetic energy to form a high velocity waterjet. The waterjet nozzle comprises superhard material and has a contracting bore. The passaged component and the waterjet nozzle are arranged such that pressurised water from the source flows through the passaged component to and through the contracting bore in the waterjet nozzle to generate the high speed waterjet. In use of the waterjet assembly, the outlet face of the passaged component is sealingly forced against the upstream face of the waterjet nozzle.

18 Claims, 5 Drawing Sheets

(56) References Cited

U.S. PATENT DOCUMENTS

Figure 1A:
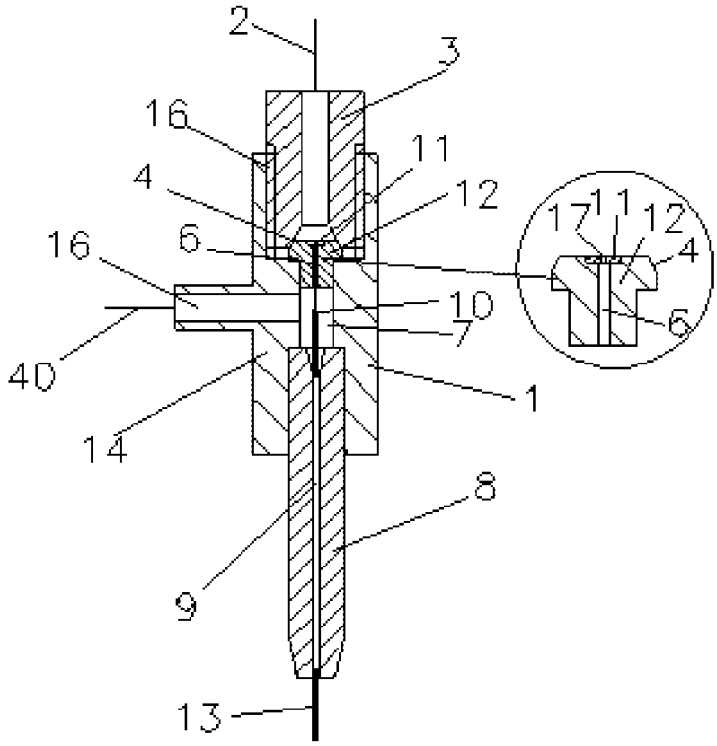
Figure 1a(Prior Art)

| | | | | |
|---|---|---|---|---|
| 6,688,947 | B2 * | 2/2004 | Anand et al. | 451/40 |
| 6,715,701 | B1 | 4/2004 | Julien | |
| 6,945,859 | B2 * | 9/2005 | Hashish et al. | 451/75 |
| 7,108,585 | B1 * | 9/2006 | Dorfman et al. | 451/38 |
| 7,757,971 | B2 * | 7/2010 | Hall et al. | 239/591 |
| 8,439,726 | B2 * | 5/2013 | Miller | 451/102 |
| 2007/0119992 | A1 | 5/2007 | Hashish | |

* cited by examiner

WATERJET ASSEMBLY COMPRISING A STRUCTURAL WATERJET NOZZLE

CROSS REFERENCE TO RELATED APPLICATIONS

This application is a national stage filing under section 371 of International Application No. PCT/EP2010/069381 filed on Dec. 10, 2010, and published in English on Jun. 16, 2011 as WO 2011/070154 A1 and claims priority of Great Britain application No. 0921681.3 filed on Dec. 11, 2009, the entire disclosure of these applications being hereby incorporated herein by reference.

BACKGROUND ART

The present invention relates to a waterjet assembly for an entrainment waterjet cutting head device.

In an entrainment cutting head of an abrasive waterjet apparatus, water at pressures of up to 6000 bar flows through a collimation tube to a waterjet generating means and creates a waterjet travelling at up to 3 times the speed of sound. The waterjet traverses a chamber between a waterjet generating means and a focus tube and enters a focus tube bore. Abrasive particles carried in a fluid are entrained into the chamber by the waterjet and on into the focus tube bore. Momentum is transferred from a waterjet to abrasive particles in a focus tube bore to produce a cutting jet at a focus tube outlet.

Abrasive is taken to mean abrasive particles of a material such as garnet, olivine or aluminium oxide. Abrasive can be transported in tubing to a cutting head dynamically suspended in airflow or it can be transported essentially statically suspended in water. Abrasive particles essentially statically suspended in water are referred to as abrasive suspension. A collimation tube is taken to mean passaged components upstream of a waterjet generating means whose passage centrelines are essentially collinear with the axis of a waterjet generating means. A waterjet generating means is taken to mean a nozzle or orifice that converts pressurised water into a waterjet.

A prior art entrainment cutting head that entrains abrasive carried in air has a waterjet generating means in the form of an orifice made from ruby, sapphire, natural diamond or monocrystalline diamond. These materials are brittle and spoil and crack if subjected to excessive point or uneven loading. An orifice is sealingly located in the front face of a carrier or is retained in sintered metal within a carrier. Water pressure forces acting on an orifice are transmitted from a waterjet orifice into a substantial body of carrier material downstream of an orifice. A carrier is designed to support a waterjet orifice and prevent an orifice acting as structural element.

To generate a high quality waterjet traveling at 2 to 3 times the speed of sound it has been found necessary to have a 100 to 1 or so contraction in area from the front face of a waterjet orifice carrier to a waterjet orifice bore. Water pressure force on the front face of a carrier is transmitted through a carrier to a cutting head body.

A threaded connection on a cutting head body is used to exert substantial force to align and to cause plastic deformation of asperities and minor errors on mating faces between a collimation tube and a waterjet orifice carrier to form a metal to metal seal. Care is taken to ensure the sealing force is not transmitted to a waterjet generating means and in particular does not affect the alignment of a waterjet generating means.

Strong re-circulation flows occur in the chamber between a waterjet orifice and a focus tube of prior art cutting heads that entrain abrasive carried in air. These re-circulation flows carry abrasive particles that erode a waterjet orifice and its carrier. Air entrainment commences as soon as a waterjet separates from an orifice edge, and this entrainment carries particles up inside the bore of an orifice when a waterjet is present to reach the region where water separates from an orifice edge to form a waterjet. Closing a valve to stop water flow through a waterjet orifice causes extreme cavitation downstream of a valve with cavitation vapour cavities collapsing on final closure of a valve. The collapse of cavities reverses flow through an orifice and can carry particles present in an orifice bore upstream of an orifice. A waterjet orifice edge can be damaged when water flow is re-started with particles upstream of an orifice. To minimise wear and damage from particles reaching an orifice a separation distance of 50 or so waterjet diameters is used between a waterjet orifice and a focus tube in prior art cutting heads. A distance of 50 or so waterjet diameters allows space for a substantial carrier to support a waterjet orifice.

To generate abrasive waterjets with diameters less than 200 microns or so that are required for micro machining it has been found necessary to substantially reduce the distance, in terms of waterjet diameters, between a waterjet generating means and a focus tube. Substantially reducing the distance between a waterjet generating means and a focus tube does not allow adequate space to support a waterjet generating means on its outlet face.

Except for a cutting head described in International Patent Application PTC/GB2006/004084 that has a waterjet nozzle attached by its upstream face to the downstream face of a carrier, prior art cutting heads that entrain abrasive suspensions are not suitable for precision machining because of poor cutting performance. Poor cutting performance results from energy dissipation by excessive turbulent mixing before a waterjet enters a focus tube and by turbulent energy dissipation as the water jet expands within the focus tube bore to fill the focus bore. Excessive turbulent energy dissipation before a focus tube can be avoided by substantially reducing the separation distance between a waterjet generating means and a focus tube compared to prior art. Preventing energy dissipation caused by a waterjet expanding to fill the full cross section of a focus tube bore requires a state of super cavitation to exist between the outlet of a waterjet generating means and a focus tube outlet. Maintaining a state of super cavitation requires the separation distance between the waterjet generating means and the focus tube to be made as small as practical, whilst allowing sufficient flow area for abrasive in suspension to enter into the focus tube inlet. It also requires that the waterjet be extremely accurate aligned along the axis of the focus tube bore.

In prior art cutting heads the alignment of waterjet generating means and focus tube centrelines depends on tolerances on at least four machining operations involving centreline locations:

a) the centreline of the waterjet generating means relative to a reference diameter on a carrier,
b) the centreline of the location diameter in a bore in a cutting head body that locates a carrier in the cutting head body,
c) the centreline location within a cutting head body of a bore for a focus tube, and
d) the location of a focus tube bore centreline relative to the outside diameter of a focus tube.

An important factor in the rapid growth of the market for abrasive waterjet machining systems was the development of entrainment cutting heads that replaced troublesome manual alignment of a focus tube bore with a waterjet by alignment through tight control over tolerances on cutting head components. Reducing cutting jet diameters to below 200 microns, to carry out micro machining, requires the centreline of a waterjet generating means to be aligned along the centreline of a focus tube within microns.

Workpiece cut surface tolerances depend on the circularity of a focus tube bore. A waterjet that is not aligned along a focus tube causes uneven and increased focus tube wear. For micromachining, a cutting head motion system desirably positions a cutting with a repeatability of 3 microns or so and a cut accuracy of 10 microns or so is desirable. This level of cut accuracy can only be met if focus tube bore wear is even around the bore circumference.

Consistently achieving a waterjet alignment within microns along the centreline of a focus tube for micro machining requires minimising the number of toleranced dimensions affecting centreline alignment.

BRIEF SUMMARY OF THE INVENTION

The objective of this invention is to provide an abrasive waterjet apparatus for macro and micro machining with a high performance cutting head that can entrain abrasive particles essentially statically suspended in water or abrasive particles dynamically suspended in airflow to produce a cutting jet.

This objective has been achieved by providing a waterjet assembly for an entrainment waterjet cutting head device, which waterjet assembly comprises

- a passaged component adapted to be connected to a source of pressurised water, and
- a waterjet nozzle for converting water pressure energy to kinetic energy to form a high velocity waterjet, which waterjet nozzle consists of superhard material and comprises a contracting bore, wherein
- the passaged component and the waterjet nozzle are arranged such that pressurised water from the source can flow through the passaged component to and through the contracting bore in the waterjet nozzle to generate said high speed waterjet, wherein
- in use of the waterjet assembly, the outlet face of the passaged component is sealingly forced against the upstream face of the waterjet nozzle.

The objective can be achieved by directly sealing a collimation tube carrying ultra high pressure water to a waterjet nozzle made of superhard material to allow a waterjet to be generated close to the inlet to a focus tube and to be precisely aligned along the axis of a focus tube. The characteristics of a waterjet and its high degree of alignment along a focus tube provide the conditions for effective transfer of momentum from a waterjet to abrasive particles in a focus tube bore to generate an abrasive cutting jet.

The waterjet nozzle acts as a structural member carrying water pressure and sealing forces from the collimation tube, also referred to as the passaged component, abutting the nozzle. The waterjet nozzle also resists erosive forces from abrasive particles flowing over its outlet face and from abrasive particles entering its bore when water flow is stopped and subsequently displaced through the nozzle when water flow is re-started.

To enable a collimation tube to be sealed to a superhard but brittle waterjet nozzle, the water pressure and sealing forces transmitted to a cutting head body are substantially reduced compared to prior art. This reduction in force is achieved by not having a carrier for a waterjet generating means on which water pressure acts on a frontal area typically 100 or so times that of the bore of a waterjet generating means. Without a carrier, the frontal area over which water pressure acts can be reduced to effectively the inlet bore area of the waterjet nozzle bore. It has been found that a nozzle bore inlet to outlet contraction area ratio of 10 provides suitable flow conditions into a waterjet nozzle without incurring excessive pressure losses.

With a waterjet nozzle area ratio of 10, the dynamic water pressure at the interface between a collimation tube and a waterjet nozzle is 1% or so of a waterjet's dynamic pressure. Frictional pressure losses associated with water flow in a collimation tube with a dynamic pressure of 1% of a waterjet's dynamic pressure are not excessive and water velocities are below those that would cause excessive erosion of a collimation tube.

Diamond has the best wear characteristics of any superhard material for generating waterjets from ultrahigh water pressure. Natural or monocrystalline diamond is used for waterjet orifices of prior art cutting heads to generate high quality waterjets. It has not proved practical to use polycrystalline (PCD) or chemical deposition (CVD) diamond for waterjet orifices because high definition orifice edge shapes are difficult to produce on crystalline materials and edges on such materials are prone to chipping. A waterjet generating means in the form of a nozzle avoids the problem of forming a high definition edge and damage to an edge from abrasive particle impacts.

A waterjet nozzle that acts as a structural element needs to be substantially more massive than a prior art waterjet orifice element to provide the contact surface for a collimation tube and to carry and transmit water pressure and sealing forces to a body of cutting head. The cost of natural and monocrystalline diamond is considerably higher than CVD diamond and much higher than PCD. PCD has higher fracture toughness than other forms of diamond, which makes it the material of choice when the cost of machining a nozzle bore is typically less than the cost of the diamond material. When the cost of drilling, and particularly polishing, a nozzle bore is high, such as for bores less than 50 microns outlet diameter, monocrystalline or CVD diamond can be preferred if drilling of a bore is followed by less or no polishing operations. Bores may be drilled by laser, electric discharge machining or other bore machining method.

Minimum sealing force occurs when contact is between two essentially optically flat surfaces. PCD blanks with essentially optical flat surfaces are produced by a number of manufactures with diameters above 20 mm. Diamond tool manufactures cut smaller tool blanks from a large PCD blank to make individual tools. Blanks for waterjet nozzles with outside diameters toleranced to 2 microns or so can be cut from a blank of this PDC and a nozzle bore centreline located within 2 microns or so relative to the outside diameter.

A precision cut blank of PCD or other superhard material with an essentially optically flat surface can be drilled to form a passaged seat with a bore to match the inlet diameter of a waterjet nozzle and the seat brazed or otherwise attached to a collimation tube. This provides for the seal between a collimation tube and a waterjet nozzle to be formed by the contact of two essentially optically flat surfaces.

Higher aligning and sealing forces are required, than with two essentially optically flat contact surfaces, if the end of a metal collimation tube has a lapped or precision-machined surface abutting an essentially optically flat surface on a waterjet nozzle.

The inside and outside diameters of ultrahigh pressure tubing used for collimation tubes is not always concentric within the tolerances required for cutting heads described in this patent application. The bore in the end of a tube may be machined true to the outside diameter so that the bore centreline is coaxial with a waterjet nozzle bore. A sufficient length of bore being machined to provide a reasonably symmetrical water velocity profile at entry to a waterjet nozzle bore. Alternatively, and preferably, a collimation seat made of super hard material, with a passage of adequate length to diameter ratio to provide appropriate flow conditions at inlet to a waterjet generating means, can be positioned between a metal collimation tube and a waterjet nozzle. It can be beneficial that a collimation seat flow passage area contracts between the inlet and outlet.

Some grades of PCD, with micron and sub micron particle sizes, are not generally available with lapped and polished surfaces. Also much of the PCD used for diamond tooling is in the form of a thick, polished layer of PCD on a tungsten carbide (WC) substrate. It is desirable to be able to use these materials for collimation seats and waterjet nozzles but without the costs involved in lapping and polishing to achieve optically flat surfaces for the interface with a metal collimation tube. This means forming a seal to an as sintered PCD surface or to the surface of a WC substrate that is also a sintered material. The surface of these sintered materials has a roughness related to their crystalline structure. Typically, surfaces have faults and other features that form depression and lines in a surface. Features at or close to an ultrahigh pressure water passage need to be filled to prevent leaks and pressurised water penetrating into a joint and increasing the force acting to separate mating surfaces.

Pressure and fatigue loading, along with the avoidance of corrosion, require high performance corrosion resistant steels be used for metal parts that form a collimation tube. A tube wall thickness one to two times the tube bore diameter is desirable to withstand ultra high water pressures. A collimation tube is required to be in the fully hard condition to maximise pressure retaining and fatigue properties and preferably autofrettaged to maximise the number of fatigue cycles it can withstand. Such a tube has a relatively low hardness compared to a superhard material; it also has a substantial contact face area with a waterjet nozzle compared to its water flow area.

It has been found that if the contact force between a metal end of a collimation tube and surface of a sintered superhard material is sufficiently high, but not too high to cause cracking, then transfer of metal to the surface of the superhard material takes place. Metal transfer is enhanced by relative rotational motion during tightening on assembly of a cutting head. Diamond, tungsten carbide or other crystals protruding from a surface indent and cause plastic flow of metal to fill voids in the superhard material surface and thereby form a seal. In effect, protruding crystals carry out a machining operation that causes metal to flow, thereby avoiding excessive point loads that could generate cracks. Importantly, metal is displaced to fill depressions and other features in the surface of sintered material.

In situations when surface faults on the material selected for a collimation seat or a waterjet nozzle are such that a seal is not readily formed because of the size of surface defects, the surface on one or both mating components can be modified to increase plasticity at the interface. In order to withstand ultrahigh water pressures and millions of pressure cycles it is necessary that any increased plasticity at an interface is only tens to a 100 microns or so in thickness. This can be achieved by surface annealing of the end of a focus tube surface using laser or other rapid limited depth annealing method, or the addition of a metal coating to one or both mating surfaces. A coating may be applied by mechanical contact means, heat as in brazing or soldering, thermal spray, vapour deposition or any other means.

To provide or enhance the plastic flow of metal at the interface between a collimation tube and a waterjet nozzle, the surface of a nozzle can be machined by laser or other means or have material deposited or grown to provide micron size surface protrusions as machining elements.

WC has higher fracture toughness than PCD making it desirable that, when practical, high point contact loads occur at a metal to WC interface.

Waterjet nozzle and collimation seat failures can occur if all of the force to align and to seal contact surfaces on superhard materials is applied when contact faces are not adequately aligned or there is debris in the interface between seating faces. A particular troublesome source of debris can be from chipping of diamond at the periphery of a face of a waterjet nozzle or collimation seat during assembly of cutting head components. Faults from manufacture and handling are common at the periphery of polycrystalline diamond materials and these faults can cause chips of diamond to become detached during assembly of cutting head components. The loss of diamond material has no adverse effect on the functioning of a waterjet nozzle or collimation seat, but if a piece of material becomes trapped between surfaces and the surfaces are forced together, spoiling or failure can occur. It has been found that collimation seat and waterjet nozzle damage and failure is avoided if only sufficient force is applied to initially seal mating faces and the majority of the sealing force is applied by water pressure. With only sufficient force to initially align and seal debris free mating faces, the conditions that could potentially lead to seat failure do not occur because when pressurised water flow starts leakage through non sealing mating faces acts to separate faces and prevent water pressure loading.

Sufficient force to just seal a collimation tube to a waterjet nozzle can be provided by a spring, with water pressure acting on the inlet end of a collimation tube to provide the main sealing force.

The thickness of the nozzle material required for a nozzle to act as a structural element can be greater than that required to form an effective nozzle bore. Since the cost of forming a nozzle bore increases rapidly with bore length it is desirable to limit a bore length to that just necessary to produce a satisfactory waterjet. For machining reasons it is desirable that a nozzle bore starts at the inlet face of the nozzle material. This means a bore outlet can be inside the material away from the downstream face of the nozzle body. In this case part or all of a chamber between a nozzle outlet and the start of a focus tube bore is formed within the body of a waterjet nozzle. A chamber is advantageously formed in WC material of a waterjet nozzle machined in a thick layer of PCD on a WC substrate.

With part of a chamber within the body of a waterjet nozzle, the minimum distance between a waterjet outlet and the start of a focus tube bore may be increased beyond the optimum distance. A factor controlling this distance is the need for a passageway into the chamber between a waterjet outlet and a focus tube bore for abrasive and carrier fluid to enter. This passageway is advantageously machined through the wall of a focus tube to a chamber formed in a focus tube. If the outlet of a nozzle bore is within the nozzle material, all or part of the passageway into the chamber may be machined into the downstream face of a waterjet nozzle body. If a waterjet nozzle is machined in PCD on a WC substrate, a passageway for abrasive and carrier fluid may be machined into the WC substrate.

A collimation seat, a waterjet generating means and a focus tube are preferably located within a housing in which their location bores are machined in one set up operation to ensure concentricity of bores.

Cutting heads that generate cutting jets less than 200 microns or so in diameter contain miniature components that pose manufacturing, handling and assembly problems. In particular the combined length of a waterjet generating means and focus tube can be less than 10 mm and they must be assembled so that:

1. Ultra high-pressure water is sealingly retained at the inlet face of the waterjet generating means.
2. The centrelines of the waterjet generating means and the focus tube are aligned within microns.
3. The waterjet nozzle and the focus tube are located in a housing that has a passageway for abrasive/water mixture to flow into a chamber between the waterjet nozzle outlet face and the focus tube bore.
4. The force acting to seal ultra high pressure water at a collimation tube/waterjet nozzle interface is transmitted to the waterjet generating means and then to a housing or to the focus tube and then to the housing.
5. All potential air leakage paths into a chamber between the waterjet generating means and the focus tube are sealed to withstand vacuums that can exceed 0.7 bar below atmospheric pressure.

Integrating a waterjet generating means and a focus tube into housing to form a cartridge assembly, preferably including a collimation seat, is desirable. A high degree of alignment and centring of bores can be achieved. Also problems in handling and assembling miniature components in a machine shop environment can be avoided by the use of exchangeable cartridge assemblies.

Focus tubes are preferably made of reacted tungsten carbide or of a polycrystalline diamond, both of which have high hardness but are extremely brittle. The outside diameter of a focus tube is usually decided on the grounds of focus tube robustness to minimise brittle failures due to accidentally impact loads on the focus tube. With a sufficiently large focus tube diameter it is practical to mount a waterjet nozzle to the focus tube with an entrainment chamber formed within the focus tube. When a waterjet nozzle is mounted to a focus tube, a seat, the waterjet nozzle and the focus tube can fit into a common bore in a cutting head body to provide the highest degree of component centreline alignment. Alternatively, a bore may be machined in a focus tube to house a waterjet nozzle, and preferably also a collimation seat.

In one aspect, there is provided an entrainment waterjet cutting head device for generating a machining jet of abrasive particles, which device comprises:

a water inlet conduit for pressurised water in the form of a collimation tube, a waterjet generating means made of superhard material for converting water pressure energy to kinetic energy to form a high velocity waterjet, a chamber traversed by said high velocity water jet, an abrasive inlet for abrasive particles and a carrier fluid, which abrasive inlet is connected to said chamber, and a focus tube arranged downstream the chamber, into which focus tube the high velocity waterjet enters entraining the abrasive particles and the carrier fluid and wherein momentum is transferred from said high velocity waterjet to the abrasive particles in the focus tube so that an abrasive machining jet exits the cutting head device, wherein:

the outlet face of the collimation tube is sealingly forced against the upstream face of the waterjet generating means, and the waterjet generating means acts as a structural element to carry and transmit the force from the collimation tube.

The force applied to the waterjet generating means through the collimation may be transferred directly from the waterjet generating means to the structure of a cutting head, or it may be transferred through a focus tube to which the waterjet generating means is mounted.

The waterjet generating means is preferably made from monocrystalline or polycrystalline diamond, boron carbide, cubic boron nitride, tungsten carbide, silicon nitride, sapphire, ruby or other superhard material with a Mohs hardness greater than 9.

Most preferably the waterjet generating means is made of diamond.

The waterjet generating means may be of composite construction such as diamond integrally bonded, encased, brazed or otherwise attached to tungsten carbide or other hard material, or it may be of diamond or other superhard material deposited or grown on a substrate such as tungsten.

A superhard facing material may be attached to the outlet end of the collimation tube.

A superhard facing material may be brazed or otherwise attached the collimation tube or to a holder that is attached to the collimation tube.

Superhard facing may be formed by deposition of a superhard coating or layer onto the end of the collimation tube.

The face of superhard facing on the collimation tube is preferably finished to be essentially optically flat.

When the outlet of the collimation tube is essentially optically flat or has a facing that is essentially optically flat the upstream face of the waterjet generating means preferably has an optically flat face.

In another aspect there is provided an entrainment waterjet cutting head device in which part of the collimation tube takes the form of a collimation seat that is interposed between a metal collimation tube and a waterjet generating means.

The collimation seat is preferably made of superhard material.

The face of the seat in contact with the waterjet generating means is preferably essentially optically flat and in contact with an essentially optically flat face on the waterjet generating means.

It is particularly advantageous to make a collimation seat from PCD on a WC substrate that has an essentially optically flat face on the PCD.

In a further aspect there is provided an entrainment waterjet cutting head device, in which the outlet end of a metal collimation tube contacts and seals to the face of a collimation seat or waterjet nozzle involving a transfer of metal from the collimation tube to the face of the seat or to the face of the waterjet generating means.

The surface of the seat or waterjet nozzle to which metal from the collimation tube is transferred is preferably a sintered surface of polycrystalline diamond or tungsten carbide.

In yet another aspect an entrainment waterjet cutting head device has a waterjet nozzle made of super hard material which is mounted on or located wholly or partially within a focus tube.

In another aspect there is provided an abrasive waterjet cutting apparatus with a cutting head in which water pressure acts on the inlet end of a collimation tube to force the outlet end of the collimation tube into sealing contact with the inlet face of a collimation seat or a waterjet generating means.

In an additional aspect there is provided a abrasive waterjet cutting apparatus with a cutting head described in proceeding aspects that is connected to a source of highly pressurised water and a source of abrasive in a carrier fluid and in which a high velocity abrasive particle/water flow is generated and discharged as an abrasive waterjet.

BRIEF DESCRIPTION OF THE DRAWING FIGURES

Figure 4:
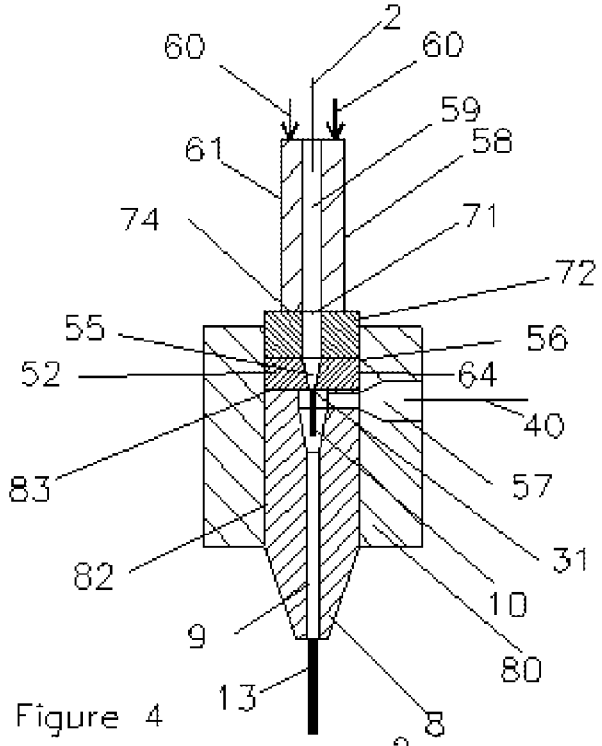
Figure 5:
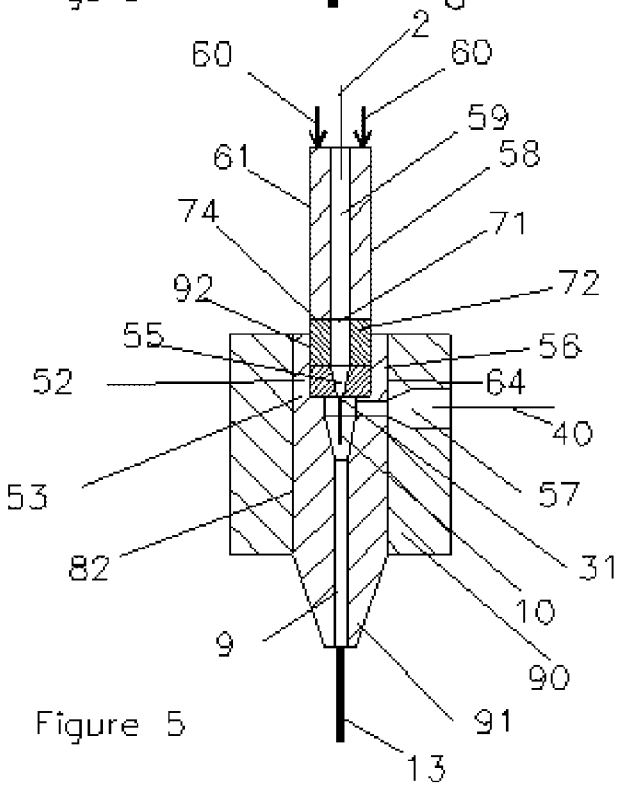
Figure 6:
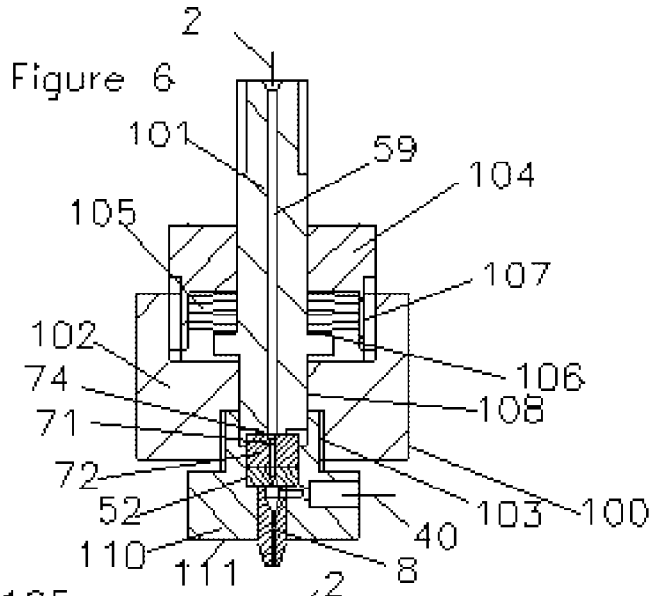
Figure 7:
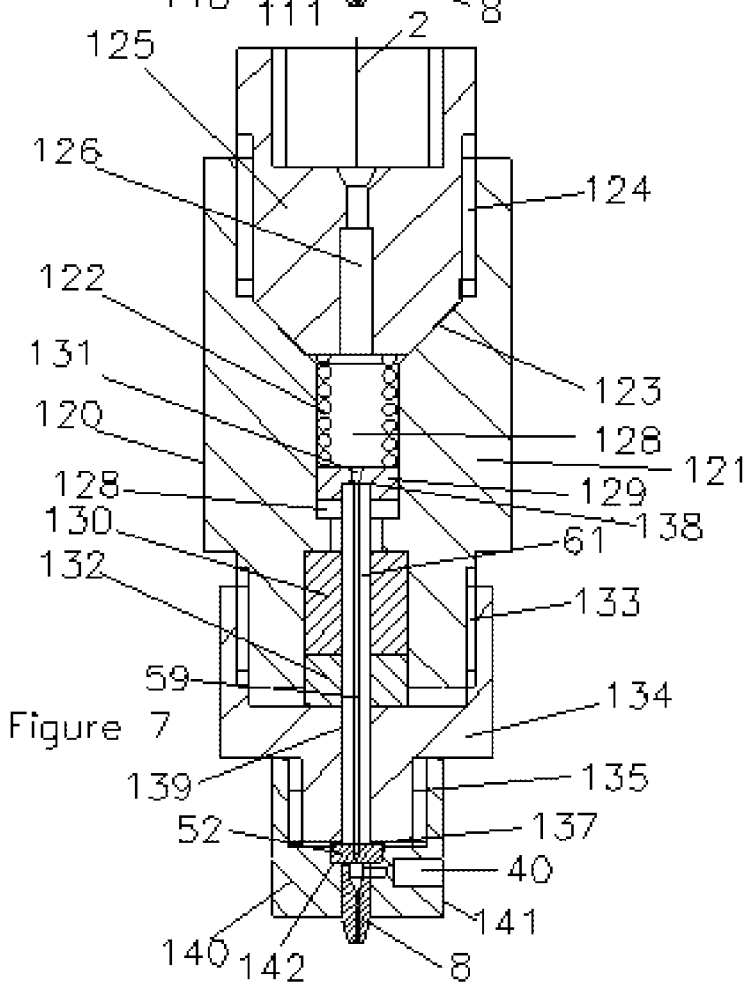
Figure 8A:
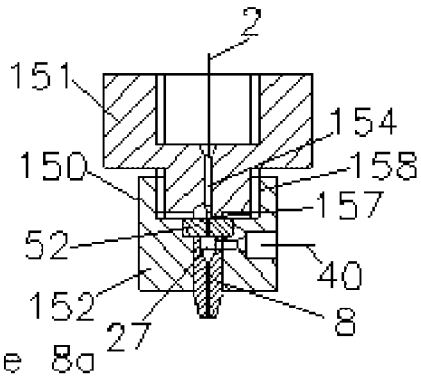
Figure 8B:
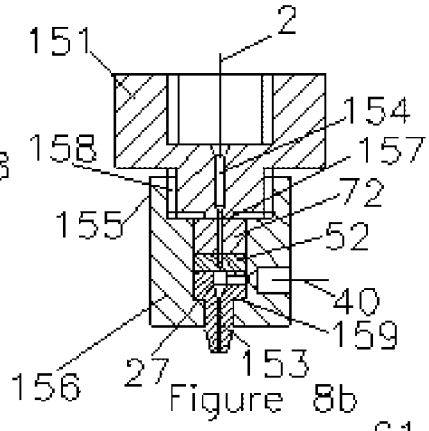
Figure 9:
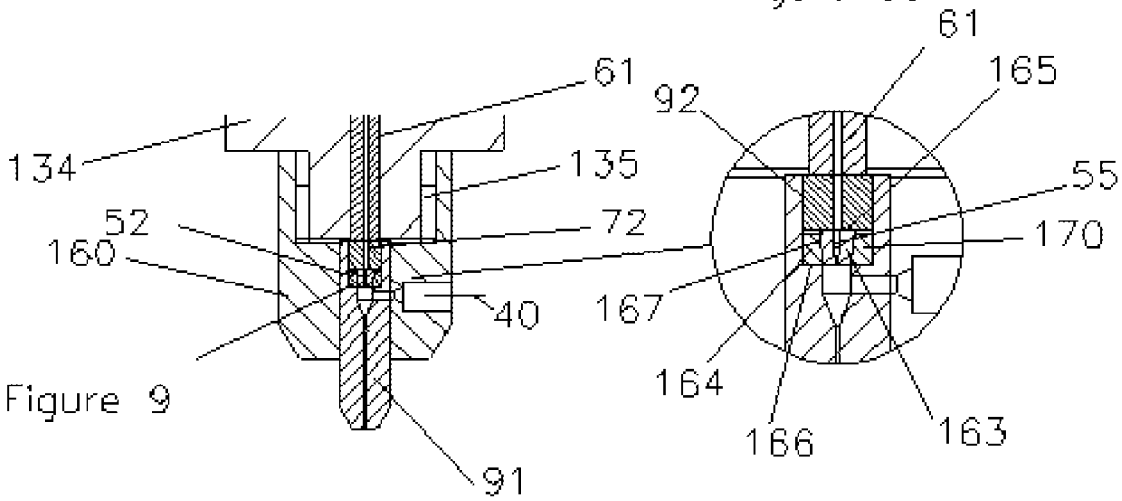
Figure 10:
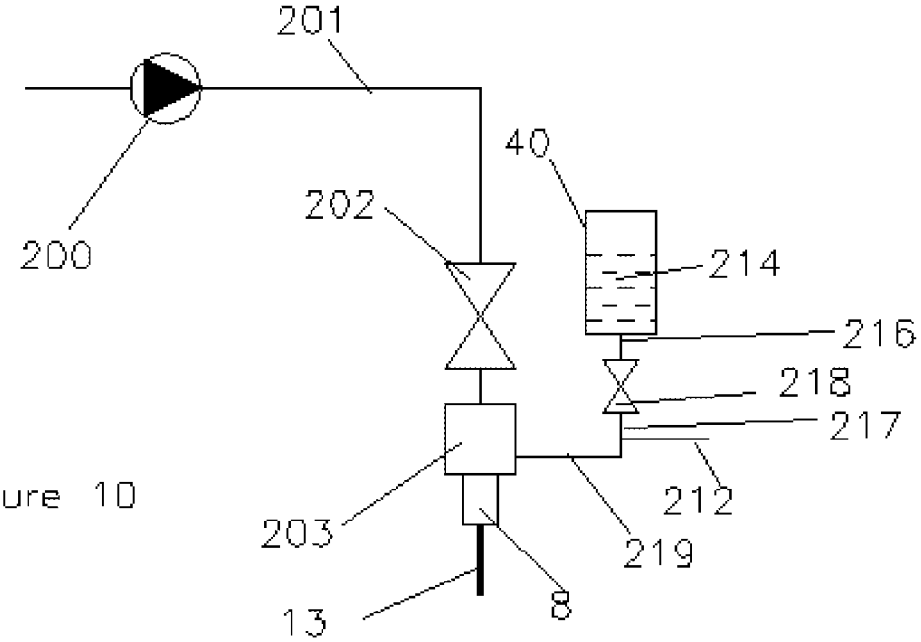

Further features and advantages of the invention will now be described with reference to the enclosed figures, where:

FIGS. 1*a,b* illustrate prior art abrasive waterjet entrainment cutting head devices, FIGS. 2 to 5 illustrate abrasive waterjet entrainment cutting head device arrangements in accordance with the invention, FIGS. 6, 7 show abrasive waterjet entrainment cutting head devices in accordance with the invention, FIGS. 8, 9 show alternative forms of abrasive waterjet entrainment cutting head device of FIG. 7 in accordance with the invention, and FIG. 10 shows a flow circuit for abrasive waterjet entrainment cutting head devices.

DETAILED DESCRIPTION

Figure 1B:
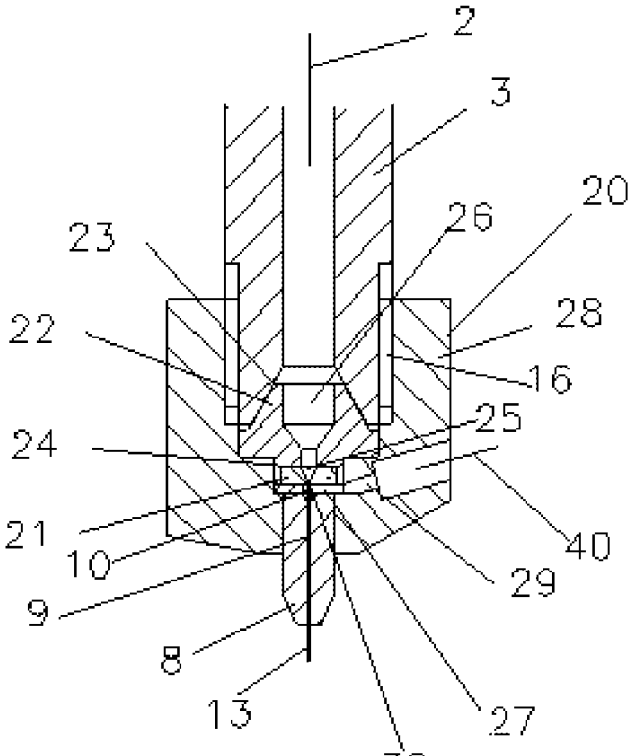
Figure 1b(Prior Art)

Referring first to FIG. 1*a* that shows a first prior art abrasive waterjet entrainment cutting head 1 with a waterjet orifice 11 located in the front face of a carrier 12, and FIG. 1*b* that shows a second prior art entrainment cutting head 20 with a waterjet nozzle 21 attached to the downstream face 24 of a carrier 22.

In the first prior art cutting head 1 pressurised water from a source 2 flows through a collimation tube 3 and discharges through the orifice 11 to form a waterjet 10. The waterjet 10 passes through a central passageway 6 in the carrier 12 before traversing a chamber 7 in a body 14 and entering a bore 9 of a focus tube 8. The drag caused by waterjet 10 passing through chamber 7 and entering focus tube bore 9 causes abrasive particles carried or suspended in a carrier fluid from a source 40 to enter through abrasive passageway 16 and be entrained into focus tube bore 9. In the focus tube bore 9 momentum is transferred from the waterjet 10 to abrasive particles to produce a cutting jet 13.

In the second prior art cutting head 20, pressurised water from a source 2 flows through a collimation tube 3 and a passageway 26 in a waterjet carrier 22 to be discharged as a waterjet 10 through a nozzle 21 that has a contracting bore 25. The waterjet 10 traverses chamber 27 and continues into bore 9 of a focus tube 8. In traversing chamber 27 the waterjet 10 entrains abrasive particles carried or suspended in a carrier fluid from a source 40 through passage 29 in body 28 to a chamber 27 and on into focus tube bore 9. In the focus tube bore 9, momentum is transferred from the waterjet 10 to the abrasive particles to produce a cutting jet 13.

In prior art cutting heads, a seat face on carrier 12, 22 mate and form a metal to metal seal 4, 23 with a seat on a collimation tube 3. A metal to metal seal may be formed on flat as well as on conical surfaces of a carrier and a collimation tube. Typically the frontal area of carriers 12, 22 are 100 or so times the cross sectional area of bore 17 at a waterjet orifice 11 or a waterjet nozzle bore 25 at outlet 30. The force required to form the metal to metal seal 4, 23 is substantial because the relatively large frontal areas of the carriers 12, 22 over which water pressure acts. The sealing force has to bring metal surfaces into alignment and plastically deform contact surfaces to achieve a face to face seal 4, 23. Thread connections 16 between collimation tubes 3 and cutting head bodies 14, 28 provide the force to achieve a face to face seal 4, 23.

A flow contraction ratio of a 100 or so into the waterjet orifice 11 has been found to be desirable to generate the extremely high quality waterjet 10 to flow through passage 6 and traverse chamber 7. Waterjet orifice 11 needs to be located remote from the focus tube 8 to minimise damage to orifice 11 and its carrier 12 by abrasive particles carried in strong circulatory flows in chamber 7 and carrier bore 6. Separation distance between an orifice and a focus tube is typically 50 waterjet diameters or so. A waterjet orifice 11 is made of a material that is superhard and on which a defined edge can be formed. Natural and polycrystalline diamonds have been found to be the best materials for waterjet orifices because they are better able to withstand erosion by abrasive particles than other superhard materials. These materials are expensive but locating and supporting an orifice 11 in the front face of a carrier 12 allows a relatively small piece of diamond material to be used.

The distance in terms of waterjet diameters between a waterjet nozzle 21 and a focus tube 8 in cutting head 20 can be much shorter than the distance between a waterjet orifice 11 and a focus tube 8 because a waterjet nozzle can withstand erosion by abrasive particles and the nozzle protects a carrier 22 from erosion. A flow contraction ratio of 10 or so over bore 25 of waterjet nozzle 21 is sufficient to generate a waterjet that is effective in entraining abrasive particles and carrier fluid into focus tube bore 9. Although the flow contraction ratio over a nozzle is 10 or so, the frontal area of carrier 22 subjected to ultrahigh water pressure ratio is typically 100 or so times the outlet area of bore 25.

In order to achieve accurate location of the centreline of a nozzle bore 25 it is necessary to machine the bore after a diamond or other superhard material blank is brazed at 24 to carrier 22. Access to the front face of waterjet nozzle 21 to machine and particularly polish bore 25 is difficult and this makes producing bore 25 several times more expensive than machining a bore in a free-standing blank. As machining a nozzle bore can account for 80 percent or so of the cost of a waterjet nozzle, it is desirable to directly seal a collimation tube to a waterjet nozzle as this allows drilling and polishing of a waterjet nozzle bore to be carried out on a free standing blank of superhard material.

As focus tube bore diameters are reduced below 200 microns it becomes increasingly difficult to align the centrelines of a waterjet generating means and a focus tube to the accuracy required for effective abrasive waterjet generation. For example a waterjet nozzle bore diameter of 35 microns would be used with a focus tube with a bore diameter of 80 microns and alignment of a waterjet along a focus tube is desirably within 2 microns or so. Consistently approaching let alone achieving such alignment tolerance is difficult with prior art cutting heads because of the number of machined surfaces that influence alignment.

Desirably, a waterjet generating means should abut a focus tube with the chamber between a waterjet generating means and a focus tube bore formed within the body of a focus tube. By this means the potential alignment of centrelines within microns can be achieved by machining of superhard materials with low material thermal expansion coefficients using ultra precision EDM and laser machining systems. Also the distance between a waterjet nozzle outlet and a focus tube bore can be optimised and all highly erosive flows take place within boundaries formed by superhard materials.

Figure 2:
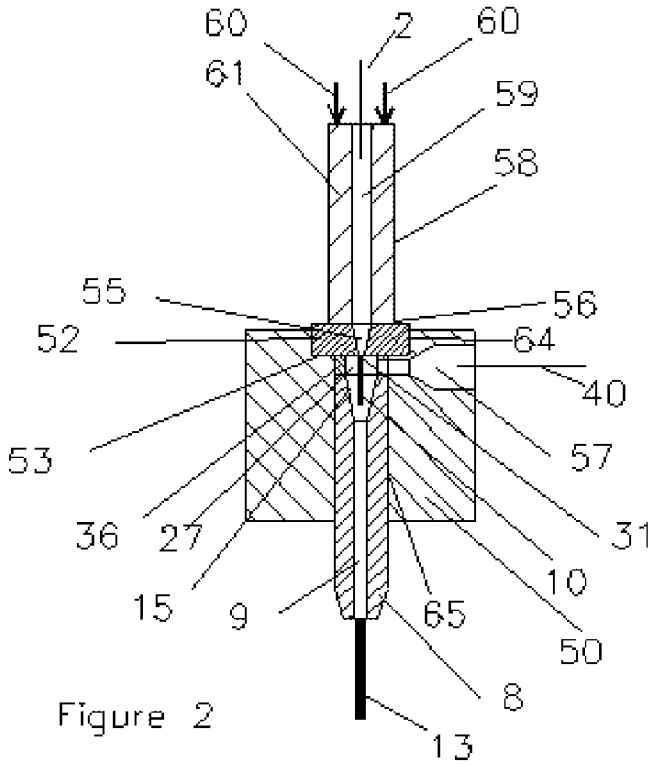

Referring now to FIG. 2 where a body 50 holds a waterjet nozzle 52 and a focus tube 8. Highly pressurised water from a source 2 flows through bore 59 of a collimation tube 61 to a contracting bore 55 in waterjet nozzle 52 to generate a high speed waterjet 10 at waterjet nozzle outlet 31. Abrasive in a carrier fluid from a source 40 passes through a passageway 57 in body 50 to a chamber 27 where it is entrained by the waterjet 10 into a contracting inlet 15 to a bore 9 of the focus tube 8 to produce a cutting jet 13. Chamber 27 may be formed within a spacer 36, located in body 50 between the nozzle 52 and focus tube 8, or the chamber 27 is preferably formed in the focus tube 8.

Collimation tube 61 abuts and seals to waterjet nozzle 52 at 56. A facing may be formed by brazing a superhard material to the outlet end of collimation tube 61 at 58, growing or depositing a superhard coating, carrying out a hardening process of the material of collimation tube 61 at 56.

To minimise sealing forces, the end of collimation tube 61 and the upstream face of the waterjet nozzle 52 may be machined and polished to achieve a flatness of a wavelength of light or so. In other words, the mating surfaces are optically flat, or at least essentially optically flat. To bring the faces into alignment at 56 and sealingly retain ultra high-pressure water, a force 60 is applied to collimation tube 61.

Force 60 applied to collimation tube 61 is beneficially provided by spring, controlled force threaded device or other form of actuation that avoids excessive force that could cause failure of a superhard but brittle waterjet nozzle 52. In order to minimise the force 60 needed to seal the interface between the collimation tube seat 62 and the waterjet nozzle 52 at 56, the collimation tube bore diameter and the waterjet inlet diameter are made essentially the same. That is to say water pressure force only acts on an area related to the inlet cross sectional area of a waterjet nozzle bore. A nozzle bore inlet area is chosen to be approximately 10 times the waterjet nozzle outlet area 31. With an area ratio of 10 the quality of a waterjet 10 is appropriate for entraining abrasive and carrier fluid into focus tube bore 9 and in transferring momentum from a waterjet 10 to abrasive particles.

Force 60 and water pressure forces are transmitted through waterjet nozzle 52 acting as a structural element to body 50 at interface 53.

Waterjet nozzle 52 is advantageously made of diamond in the form of CVD, PCD or monocrystalline. These forms of diamond are available in various thicknesses in forms and widely used for diamond cutting tools. Manufacturers of diamond cutting tools cut tool blanks from larger blanks. Blanks are available with or without lapped and polished faces. Waterjet nozzle blanks cut from a large blank with lapped and polished surfaces have surfaces that are essentially optically flat and parallel. A bore 55 is machined on the centreline of a precision cut blank using laser, electric discharge or other means and bore 55 may be finished by polishing.

Because of the low fracture toughness of superhard materials, a waterjet nozzle thickness is usually chosen on the basis of minimising the risk of waterjet failure due to cracking from loads arising from mis-alignment of surfaces and debris trapped between surfaces. However, the cost of drilling and finishing a nozzle bore 55 increases as bore length to bore outlet diameter exceeds 10. For waterjet outlet diameters less than 100 microns or so, PCD with a thickness of 1 mm has proved to be desirable even though bore lengths are above the optimum for the machining of a nozzle bore 55. A waterjet nozzle with a bore outlet diameter under 100 microns will typically have an outside diameter of 3 mm or so.

An important benefit of the arrangement shown in FIG. 2 is the minimum number of potential paths for air leakage from the environment into chamber 27. The face on waterjet nozzle 52 at 53 seals against a machined face on body 50 and the interface 65 between body 50 and focus tube 8 can be sealed using a polymeric seal or by retaining focus tube in body 50 using adhesive or by other means.

Figure 3:
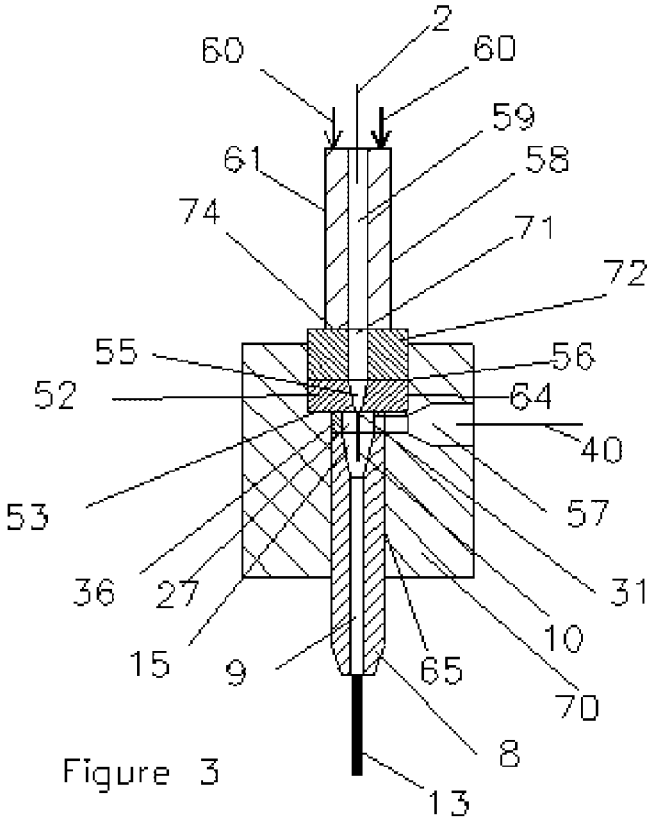

Referring now to FIG. 3 that shows a body 70 in which are located a collimation seat 72, a waterjet nozzle 52 and a focus tube 8. The collimation seat 72 acts as an extension of collimation tube 61 and is preferably made of a superhard material. Collimation seat 72 is located in the same bore in body 70 as the waterjet nozzle 52 to provide for good alignment of bore centrelines.

The length to diameter ratio of a bore 71 in collimation seat 72 is chosen to be sufficient to correct for centreline misalignment and differences in diameter at the interface 74 between a metal tube and collimation seat bore 71. It has been found advantageous to use PCD sintered on a WC substrate for a collimation seat 72, with the surface of the PCD lapped and polished to be essentially optically flat. Blanks of this material, with an essentially optically flat diamond surface, are used for making diamond cutting tools. Such blanks are available with WC thicknesses up to 5 mm as standard, providing for adequate bore 71 length to diameters ratios to generate a suitable velocity profile at inlet to a waterjet nozzle bore 55.

The sintered surface of PCD and WC that has not been lapped has a roughness depending on material particle grain size. Surfaces also have numerous features that can include interconnected depression. By controlling the force at the interface of a metal collimation tube 61 and a collimation seat 72 at 74, it has been found that plastic flow of metal occurs and metal is transferred from the end of a collimation tube to a sintered surface to form a seal. In effect, edges on crystal grains protruding a sintered surface machine and cause plastic deformation of the end face of a collimation tube. A growth surface of CVD diamond can have sufficiently fine crystal formations that a metal collimation tube may be directly sealed to such a surface.

If surface conditions to which a collimation tube seals are such that a seal is not readily formed then the end face of the collimation tube 61 may be annealed to a depth of 100 microns or so to enhance plastic metal flow. Alternatively a contact surface on a collimation tube 61 and/or a collimation seat 72 or waterjet nozzle 52 may be coated with a layer 100 microns or so in thickness of a metal or other material that plastically deforms more readily than the hard stainless steel normally used for a collimation tube.

The surface of a waterjet nozzle 52 or collimation tube 72, that interfaces with a metal surface of a collimation tube 61, may have the surface modified by etching or machining or by depositing or growing such that the surface has protruding elements microns in height that cause plastic flow of collimation tube 61 metal to form a seal when the faces are forced together by force 60.

FIG. 4 shows an arrangement similar to FIG. 3 except a waterjet nozzle 52 and a focus tube 8 have the same outside diameter. Forces on the waterjet nozzle 52 are transmitted at 83 to the focus tube 8 and then into the body 80 at 82 by an interference fit, adhesive joint or features on the outside of focus tube 8 that match with features in bore 82 of body 80. A particular advantage of this arrangement is the location of a collimation seat 72, a waterjet nozzle 52 and a focus tube 8 in a common bore in body 80 to provide the best arrangement for aligning the centreline of bores in these components within microns.

FIG. 5 shows a further arrangement of cutting head components in which a seat 72 and a waterjet nozzle 52 are located within a bore 92 machined in the inlet end of a focus tube 91.

As with FIG. 4 this arrangement provides the potential for centreline alignment of a seat 72, waterjet nozzle 52 and a focus tube 8 within microns.

Focus tubes with good wear characteristics are usually made of reacted tungsten carbide and are particularly brittle. Focus tubes break under impact loads such as hard contact with a work piece. The practice is to make focus tube 8 many times larger in diameter than is necessary for its primary function of providing a bore 9 in which momentum is exchanged between a waterjet and abrasive particles. The arrangements of FIGS. 4 and 5 take advantage of the practice of using robust focus tubes.

Referring now to FIG. 6 that shows a cutting head 100 with the arrangement of a collimation seat 72, a waterjet nozzle 52 and focus tube 8 generally as in FIG. 3. Pressurised water from source 2 flows through a bore 59 in a member 101 that acts as a collimation tube to a bore 71 in collimation seat 72. The functioning of collimation seat 72, waterjet nozzle 52 and focus tube 8 are as for FIG. 3. Collimation seat bore 71 is shown with a contracting inlet at 74 to accommodate misalignment of a focus tube bore 59 and a collimation seat bore 71.

Body 70 of FIG. 3 is replaced by a body 110 in FIG. 6 which with a collimation seat 72, a waterjet nozzle 52 and a focus tube 8 forms a cartridge assembly 111. Cartridge 111 is attached at 103 to second body 102 in which collimation tube member 101 is free to move axially. Gland 104 attached by thread 107 to second body 102 acts on spring washers 105 to apply a force at 106, equivalent to force 60 of FIG. 3, to collimation tube member 101 and thereby to seat 72 at interface 74.

Controlled tightening of gland 104 provides a desired force 60 at interface 74. Spring washers 105 can be replaced by other forms of springs or by controlled torque loading of gland 104 acting directly on collimation tube member 101 or by controlled torque loading through threaded connection 103 between body 110 and body 102.

Referring now to FIG. 7 which shows a cutting head 120 in which the sealing force between a collimation tube 61 and a waterjet nozzle 142 is related to water pressure. Abrasive waterjets operate with water pressures up to 6000 bar, with the most common operating pressures being between 3000 and 4000 bar. If a cutting head is required to operate over a wide range of pressures it can be desirable that the contact force between cutting head elements is related to water pressure. This allows lower initial assembly forces to be used. Subsequent increase in sealing force due to water pressure have been found less likely to cause brittle failure of a waterjet nozzle or collimation seat than applying a force during assembly that is needed to resist the maximum water pressure that may occur. If corresponding mating faces on a collimation tube, collimation seat or waterjet nozzle are poorly aligned or there is debris between faces, water leakage on initial pressurisation prevents full pressurisation and avoids high local forces that could lead to brittle failure.

Pressurised water from source 2 flows through passageway 126 in a union 125 to a chamber 128 of a first body 121. Union 125 is sealed to body 121 by force from threaded connection 124 making a metal to metal seal at 123. A collimation tube 61 enters chamber 128 through a seal 130 which has a backup ring 132 retained by a second body 134 attached to first body 121 by thread 133.

Guide 129, which is a lose sliding fit in chamber 128 so that water pressure is balanced across the guide 129, has an inlet 131 for water entering from chamber 128 into collimation tube bore 59 and the guide contacts collimation tube 61 at 138. A spring 122 applies a force to guide 129 and hence to collimation tube 61 at 138. Collimation tube 61 is free to move axially in bore 139 of second body 134 and contacts a waterjet nozzle 52 at 137. Forces on waterjet nozzle 52 are transferred at interface 142 to cartridge body 140. Cartridge body 140 containing a waterjet nozzle 52 and a focus tube 8 forms a cartridge 141. Cartridge 141 is attached to second body 134 by thread 135 or other means of attachment.

Waterjet nozzle 52 may have inlet contact surface at 137 and outlet contact surface at 142 that are sintered surfaces.

Spring 122 acts to hold collimation tube 61 at interface 137 in contact with waterjet nozzle 52 when there is no water pressure. Importantly, when a seal is made to a sintered surface, spring 122 forces the end face of collimation tube 61 against a surface of waterjet nozzle 52 or if a collimation seat is present against the surface of a collimation seat 72. During assembly of a cartridge 141 to second body 134, a spring 122 provides the force to cause transfer of metal from a collimation tube 61 surface at 137 to a sintered surface of a waterjet nozzle 52 to form a seal at 137 to retain water pressure.

When water is pressurised in chamber 128, water pressure acts on the inlet end of collimation tube 61 to further force collimation tube 61 outlet end at 137 against waterjet nozzle 52.

Referring now to FIGS. 8*a* and 8*b* that show cutting head assemblies 150 and 155 in which a waterjet nozzle 52 or collimation seat 72 seals directly to the cutting head body 151. The force to cause a seal at the interface 157 between cutting head body 151 and a waterjet nozzle 52 or a collimation seat 72 is generated by assembling cartridge body 152, 156 to cutting head body 151 using thread 158 and controlling the sealing force through the torque applied in assembling cartridge 152, 156 to body 151.

The surface of the waterjet nozzle 52 or the collimation seat 72 contacting the surface of the metal cutting head body 151 at 157 is preferably formed of superhard protruding crystal or elements that cause plastic flow of metal to form a seal at 157. The cutting head body is a relatively low cost item that can be replaced after repeated mounting and dismounting of cartridge 152 and 156 causes excessive damage to the metal face at 157.

The passage 154 in body 151 may have a contraction in area upstream of interface 157.

Focus tube 153 has a step 159 on its outer diameter through which the force 60 is transmitted from the cartridge body 156 to the focus tube.

FIG. 9 shows a cartridge assembly 160 of the form shown in FIG. 5 that could be used in place of cartridge 141 of FIG. 7. The waterjet nozzle 170 takes the form of a superhard material 163 encased or retained in another material 164 that can also be a superhard material. PCD encased in tungsten carbide is used for wire drawing dies and is available in fine particle grades suitable for forming a waterjet nozzle bore 55.

For waterjet nozzle bores less than 50 microns or so outlet diameter it can be practical to use natural diamond for the part 163 of a waterjet nozzle 170 in which bore 55 is machined. The diamond is encased in a support material 164 and an inlet face of the diamond at 165 lapped and polished to be parallel with the downstream face of the casing 164 at 166. A diamond 163 may be encased in sintered material 164 or be shaped such as with a taper to be retained in the encasing material 164.

FIG. 10 shows a schematic arrangement of a flow circuit for an entrainment abrasive waterjet apparatus. Pump 200 supplies highly pressurised water via conduit 201 and valve 202 to a waterjet generating means in cutting head 203. Abrasive particles 214 flow out of source vessel 40 through valve 218 and are transported by a carrier fluid through conduits 217, 219 to cutting head 203. In cutting head 203 the particles and carrier fluid are entrained by a waterjet into a focus tube 8 to generate an abrasive waterjet 13.

When abrasive is carried in air to a cutting head the metering of abrasive is usually carried out immediately after valve 218 in connection 217 with abrasive being picked up by air entering through connection 212 and carried dynamically through connection 219 to cutting head 203. When abrasive flows to a cutting head 203 suspended in water, metering of abrasive suspension is usually carried out in connection 219.

It is accepted practice to remove the abrasive entrainment part of an entrainment cutting head so as to have a pure waterjet to cut soft materials like plastics and food products. The cutting heads described in this patent can also be adapted to operate with a plain waterjet.

The invention claimed is:

1. A waterjet assembly for an entrainment waterjet cutting head device, said waterjet assembly comprising:

a passaged component having an elongate passage bore extending through the passaged component and adapted to be connected to a source of pressurised water, a direction of flow of said pressurised water through the assembly defining an upstream direction and a downstream direction, and a waterjet nozzle for converting water pressure energy to kinetic energy to form a high velocity waterjet, said waterjet nozzle being of superhard material and comprising a nozzle bore converging from a wider upstream end to a narrower downstream end, wherein the passaged component and the waterjet nozzle are arranged such that pressurised water from the source of pressurized water flows through the passaged component to and through said nozzle bore in the waterjet nozzle to generate said high velocity waterjet, and wherein in use of the waterjet assembly, a downstream face of the passaged component is forced against an upstream face of the waterjet nozzle to form a first seal.

2. The waterjet assembly of claim 1, wherein the waterjet nozzle is a structural element adapted to receive a sealing force from the passaged component.

3. The waterjet assembly of claim 1, wherein the passage bore of the passaged component and the nozzle bore of the waterjet nozzle have substantially the same diameter at a point where said passage bore and said nozzle bore meet.

4. The waterjet assembly of claim 1, wherein the downstream face of the passaged component and the upstream face of the waterjet nozzle each comprise essentially optically flat surfaces.

5. The waterjet assembly of claim 1, wherein the superhard material of the waterjet nozzle is selected from diamond and diamond supported on a substrate wherein the nozzle bore extends through the substrate and the diamond, with a downstream exit end of the nozzle bore extending through said diamond.

6. The waterjet assembly of claim 1, wherein the passaged component is made of metal except for a seat of superhard material located at a downstream end of the passaged component, such that said seat is interposed between the waterjet nozzle and a remainder of the passaged component, wherein an upstream face of the seat has a surface having superhard protrusions extending from it, such that when a downstream surface of the remainder of the passaged component is forced against the upstream face of the seat, a second seal is formed between the seat and the remainder of the passaged component with said superhard protrusions extending into the metal of the remainder of the passaged component and the metal of the remainder of the passaged component filling voids between said superhard protrusions.

7. The waterjet assembly of claim 6, wherein the seat comprises a layer of polycrystalline diamond supported on a substrate of sintered tungsten carbide and wherein a downstream face of said layer of polycrystalline diamond is essentially optically flat.

8. An entrainment waterjet cutting head device comprising:

a waterjet assembly comprising:

a passaged component having an elongate passage bore extending through the passaged component and adapted to be connected to a source of pressurised water, a direction of flow of said pressurised water through the assembly defining an upstream direction and a downstream direction, and a waterjet nozzle for converting water pressure energy to kinetic energy to form a high velocity waterjet, said waterjet nozzle comprising superhard material and comprising a nozzle bore converging from a wider upstream end to a narrower downstream end, wherein the passaged component and the waterjet nozzle are arranged such that pressurised water from the source of pressurized water can flow through the passaged component to and through said nozzle bore in the waterjet nozzle to generate said high velocity waterjet, and wherein in use of the waterjet assembly, a downstream face of the passaged component is forced against an upstream face of the waterjet nozzle to form a first seal;

a chamber traversed in use by said high velocity waterjet an abrasive inlet for inflow of abrasive particles suspended in a carrier fluid, said abrasive inlet leading to said chamber, an outlet tube extending downstream from the chamber, coaxially with the passage bore and the nozzle bore, such that the high velocity waterjet entrains the abrasive particles and the carrier fluid from the abrasive inlet and passes into the outlet tube, momentum is transferred from said high velocity waterjet to the abrasive particles within the outlet tube, and an abrasive machining jet is emitted from a downstream end of the cutting head device, and a cutting head body.

9. The entrainment waterjet cutting head device of claim 8, further comprising a detachable housing adapted to hold the waterjet nozzle and the outlet tube, such that when the detachable housing is mounted to the cutting head body, the passaged component is urged against the waterjet nozzle to produce at least part of a sealing force that forces the downstream face of the passaged component against an upstream face of the waterjet nozzle to form the first seal.

10. The entrainment waterjet cutting head device of claim 9, wherein an external diameter of the waterjet nozzle is larger than an external diameter of the outlet tube, and wherein the detachable housing comprises first and second coaxial passageways having diameters to receive the waterjet nozzle and the outlet tube respectively, said coaxial passageways being adapted such that a portion of a downstream face of the waterjet nozzle is directly supported by the detachable housing and said sealing force is transmitted through the waterjet nozzle to the detachable housing.

11. The entrainment waterjet cutting head device of claim 9, wherein said chamber is formed within the outlet tube, and the waterjet nozzle and the outlet tube each have the same external diameter and fit within a common passageway through the detachable housing, so that said sealing force is transmitted from the waterjet nozzle to the outlet tube and from the outlet tube to the detachable housing.

12. The entrainment waterjet cutting head device of claim 9, wherein said chamber is formed within the outlet tube, and wherein the outlet tube comprises a further passageway upstream of the chamber within which further passageway the waterjet nozzle is located, such that said sealing force is transmitted from the waterjet nozzle to the outlet tube and through the outlet tube to the detachable housing.

13. The entrainment waterjet cutting head device of claim 8, so adapted that said pressurised water acts on an upstream end of the passaged component to force the downstream face of the passaged component into sealing contact with the upstream face of the waterjet nozzle.

14. The entrainment waterjet cutting head device of claim 9, wherein the passaged component comprises a seat of superhard material at its downstream end, and the waterjet nozzle and the seat are located within a common passageway in the detachable housing.

15. A waterjet assembly for an entrainment waterjet cutting head device, said waterjet assembly comprising:

a passaged component having an elongate passage bore extending through said passaged component, and being connectable to a source of pressurised water such that a direction of flow of said pressurised water through the waterjet assembly defines an upstream direction and a downstream direction;

a waterjet nozzle to form a high velocity waterjet, said waterjet nozzle comprising a superhard material and having a nozzle bore extending through it that converges from a wider upstream end to a narrower downstream end;

the passage bore of the passaged component and the nozzle bore of the waterjet nozzle being coaxially aligned to permit said pressurised water to flow to the nozzle bore and be emitted from the narrower downstream end of the nozzle bore as said high velocity waterjet; and a downstream face of the passaged component being forced in use against an upstream face of the waterjet nozzle to form a first seal.

16. The waterjet assembly of claim 1, wherein the passaged component comprises metal and a seat of superhard material is mounted to a downstream end of the passaged component by a technique selected from brazing and welding, said seat comprising a substrate of sintered tungsten carbide having a layer of polycrystalline diamond applied to a downstream face of the seat, said layer of polycrystalline diamond being essentially optically flat, so as to form a seal against an essentially optically flat upstream face of the waterjet nozzle.

17. The entrainment waterjet cutting head device of claim 8, wherein the passaged component of the waterjet assembly comprises a portion of the cutting head body.

18. The waterjet assembly of claim 1, wherein the passaged component is made of metal and the upstream face of the waterjet nozzle has a surface having superhard protrusions extending from it, such that when the downstream face of the passaged component is forced against the upstream face of the waterjet nozzle, said first seal is formed with said superhard protrusions extending into the metal of the passaged component and the metal of the passaged component filling voids between said superhard protrusions.

* * * * *